US005458416A

United States Patent [19]

Edwards et al.

[11] Patent Number: 5,458,416

[45] Date of Patent: Oct. 17, 1995

[54] FLUIDIC MIXER

[76] Inventors: Kenneth N. Edwards, 2926 Graceland Way, Glendale, Calif. 91206; Michael C. Lapp, Sr., 14717 Libra Dr., La Mirada, Calif. 90638

[21] Appl. No.: 263,030

[22] Filed: Jun. 20, 1994

[51] Int. Cl.[6] ..... B01F 9/00

[52] U.S. Cl. ..... 366/209; 366/212; 366/214; 366/605

[58] Field of Search ..... 366/208, 209, 366/210, 211, 212, 213, 214, 216, 217, 219, 220, 240, 605

[56] References Cited

U.S. PATENT DOCUMENTS

| | | | |
|---|---|---|---|
| D. 254,973 | 5/1980 | Sorensen | D15/147 |
| 4,134,689 | 1/1979 | Ahrenskou-Sorensen | 366/110 |
| 4,281,936 | 8/1981 | Schotter | 366/209 |
| 4,445,782 | 5/1984 | Sparrow | 366/605 |
| 5,116,134 | 5/1992 | Edwards et al. | 366/208 |
| 5,268,620 | 12/1993 | Hellenberg | 366/209 |

*Primary Examiner*—Robert W. Jenkins
*Attorney, Agent, or Firm*—Stetina Brunda & Buyan

[57] ABSTRACT

A mixer for mixing a container's contents has a holder for holding the container, a first mechanism for effecting rotation of the holder, and a second mechanism for effecting reciprocating linear motion of the holder. The first mechanism effects rotation of the holder and the second mechanism effects reciprocation of the holder simultaneously so as to effect thorough mixing of the contents of the container held thereby.

25 Claims, 5 Drawing Sheets

Fig. 5
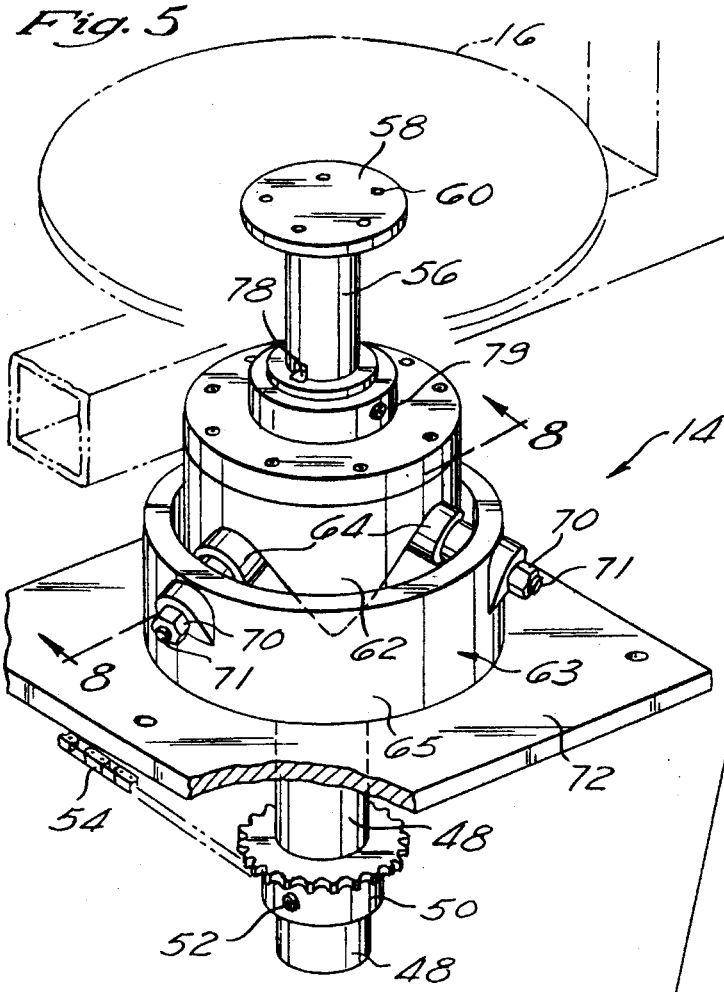
Fig. 6
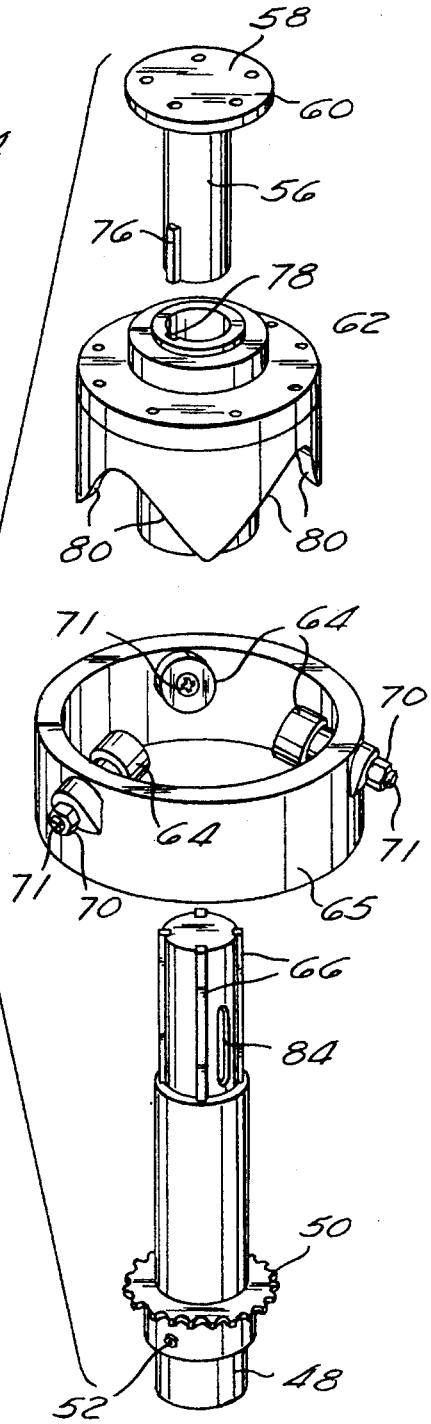
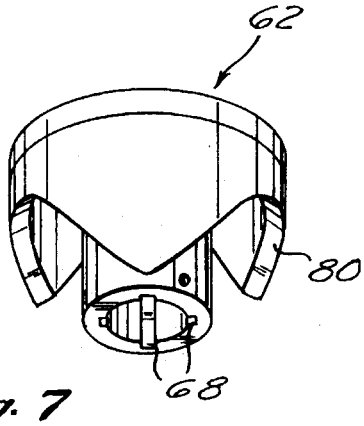
Fig. 7

FLUIDIC MIXER

FIELD OF THE INVENTION

The present invention relates generally to mixing devices and more particularly to a fluidic mixer for mixing fluids and/or solids within a container which is particularly adapted for mixing paints.

BACKGROUND OF THE INVENTION

Various different products are manufactured by first combining ingredients into a container, then sealing the container and effecting mixing of the contents. For example, pulverulent or liquid products are typically amenable to such production techniques.

One example of such production techniques occurs in the manufacture of paint. In order to manufacture paint, a liquid paint base is disposed within a container. Then various tinting agents or pigments and/or other additives are added to the paint base. The paint base and the pigments and/or other additives must then be thoroughly mixed so as to provide uniform color and/or various other properties throughout the contents of the container.

The addition of such pigments and/or other additives may be performed at either the facility of a local vender or at the manufacturing facility. In either instance, the pigments and/or other additives are commonly added to the paint base within a paint can, typically having either one or five gallon capacity, and the paint can is then vibrated or shaken in an attempt to thoroughly mix the contents of the paint can. Such mixing of the contents of the paint can may be performed by either bench-top mixers or floor-mounted mixers, both of which are operated by personnel who must insure that the container is properly sealed and securely clamped within the mixing apparatus. Operating personnel must also assure that the mixing process proceeds for an adequate length of time, so as to assure thorough mixing.

Examples of such manually operated mixing equipment are provided in U.S. Pat. No. 4,134,689 and U.S. Design Pat. No. D254,973. These patents disclose a floor-mounted apparatus which is adapted to receive a container, the contents of which are to be mixed. An operator adjusts a motor-operated clamping mechanism so as to assure that an adequate clamping force is applied to the container. The operator then initiates the mixing cycle and thereafter unclamps and removes the container from the apparatus. The mixer typically shakes the paint container in a generally linear reciprocating fashion.

It is also known to mix paint utilizing a gyroscopic motion as described in U.S. Pat. No. 5,116,134, issued on May 26, 1992 to Edwards et al. and entitled AUTOMATED PAINT PRODUCTION APPARATUS, wherein the paint container is simultaneously rotated about two perpendicular axes.

Those skilled in the art will recognize that it is not uncommon for paint, paint cans, mixer parts, etc. to undesirably be propelled from the paint mixer, due to inadequate clamping, loosening of parts, etc. A housing is generally provided so as to surround the paint being mixed and the moving parts of the mixer in order to prevent damage to adjacent equipment and/or potential injury to nearby personnel in the event that a paint container or a part of the paint mixer loosens and is hurled by the rapidly moving parts of the mixer therefrom.

Although such contemporary paint mixers have proven generally suitable for their intended purposes, they possess inherent deficiencies which detract from their overall effectiveness in the marketplace. Such contemporary paint mixers require excessively long mixing times in order to assure adequate mixing of the paint base, pigments, and/or any additives. Indeed, some contemporary paint mixers, particularly those utilizing linear reciprocating motion, frequently provide inadequate mixing of the paint base, pigment, and/or additives. Such inadequate mixing frequently results since the heavier pigments may remain relatively stationary due to the effects of inertia, as the paint base is moved back and forth relative thereto, resulting in insufficient mixing thereof.

As such, it is desirable to provide a paint mixer which mixes paint base, pigment, and/or any additives thoroughly and in substantially less time than that required by contemporary mixers.

Furthermore, contemporary mixers typically utilize clamping mechanisms wherein a lead screw, typically driven by an AC motor, effects movement of two clamping members toward one another. As those skilled in the art will appreciate, contamination of the lead screw, typically resulting primarily from spilled or splashed paint, reduces the effectiveness of the lead screw to properly effect clamping of the paint container. Contaminants typically adhere to the threads of the lead screw and harden so as to inhibit rotation of the lead screw through an associated threaded countermember or nut and also frequently provide a false indication of proper clamping. Thus, a contemporary clamping mechanism may sense reduced or non-rotation of the lead screw, due to contamination thereof, and incorrectly interpret such sensing as tight or proper clamping of the paint container.

Therefore, an inadequately clamped paint container may be shaken when utilizing a contemporary paint mixer having a soiled or contaminated lead screw. The shaking of such an inadequately clamped container is likely to result in further spillage and/or splashing of the paint, consequently resulting in further contamination of the lead screw, thus perpetuating the problem.

As such, it is beneficial to provide a clamping mechanism which is not subject to lead screw contamination, and which consequently does not result in improper clamping of the paint container.

Thus, although such prior art mixers have proven generally suitable for their intended purposes, they posses inherent deficiencies which detract from their overall effectiveness in the marketplace.

Additionally, contemporary paint mixers utilize an AC motor to effect actuation of the clamping mechanism thereof. Motor current is monitored so as to provide an indication that adequate clamping has been achieved. Such use of AC motors is common due to the availability of AC current, i.e., wall outlets. However, the monitoring of current in such AC motors does not provide as good an indication of proper clamping as would the monitoring of motor current for a DC motor utilized in a like application. As such, it is desirable to provide a fluidic mixer utilizing a DC motor to effect clamping of a container therein, wherein the motor current is monitored so as to provide an accurate and reliable indication of proper clamping.

SUMMARY OF THE INVENTION

The present invention specifically addresses and alleviates the above-mentioned deficiencies associated with the prior art. More particularly, the present invention comprises a mixer for mixing a container's contents. The mixer comprises a holder for holding the container, a first mechanism for effecting rotation of the holder, and a second mechanism for effecting reciprocating linear motion of the holder. The first mechanism effects rotation of the holder and the second mechanism effects reciprocation of the holder simultaneously so as to effect thorough mixing of the contents of the container.

The holder preferably comprises a clamp having a first plate upon which the container is supported and a second plate disposed generally parallel to the first plate and movable toward and away from the first plate so as to effect clamping of one or more containers therebetween.

A housing preferably substantially encloses the holder so as to mitigate problems associated with spillage of the contents of the container and/or hurling of the paint container and/or mixer parts from the mixer. The housing prevents spilled paint, paint cans, parts, etc., from escaping the mixer and thus soiling or injuring nearby personnel, equipment, etc.

At least one motorized lead screw is utilized to effect movement of the second plate toward and away from the first plate. A common motor may optionally be utilized to drive a plurality of such lead screws.

The mixer preferably comprises a generally rectangular frame having a first end member upon which the first plate is disposed, a second end member upon which the second plate is disposed, two first side members extending from the first end member, and two second side members extending from the second end member, each of the second side members slidably engaging one of the first side members. Preferably, two lead screws extend along each engaged first and second side members, preferably disposed therein, so as to effect sliding of the second side members relative to the first side members to effect clamping.

The lead screws are preferably sealed within the first and second side members, preferably via a DELRON seal disposed between the telescoping portions of the first and second side members so as to prevent contamination of the lead screw.

The first mechanism, which effects rotary motion of the clamp and the container clamped therein, comprises a first shaft rotatably driven by a motor and a second shaft preferably co-linear to and slidably engaging the first shaft such that the first shaft rotatably drives the second shaft.

The second mechanism, which effects reciprocating linear motion of the clamp and the container clamped therein, comprises a cam having an annularly configured bearing surface formed upon the second shaft, and at least one, preferably three, rollers upon which the cam rides upon so as to effect reciprocating linear motion of the second shaft.

The cam is preferably generally annular in configuration and is co-axially aligned with the second shaft. The cam preferably comprises a beveled bearing surface contacting a complimentary beveled surface formed upon the rollers so as to effect self-centering of the second shaft. The beveled surface of the cam preferably defines a 32-degree angle relative to the horizontal plane of the mixer. Those skilled in the art will recognize that various other configurations of the cam and rollers are likewise suitable for attaining such self-centering.

At least one biasing means or spring, preferably two separate springs, urge the cam and cam rollers into abutting contact with one another.

The present invention thus comprises an automated apparatus for mixing ingredients stored in closed containers by simultaneously rotating and reciprocating the container in a manner which effectively and efficiently effects mixing of the contents thereof.

The mixer may be specifically adapted to accommodate the mixing of paint base with pigments and/or other additives while contained within the same containers within which the paint is sold to the end user. Such application of the fluidic mixture of the present invention is by way of illustration only and not by way of limitation. Those skilled in the art will recognize that various different fluids and/or solids, contained within various different types and configurations of containers, may likewise be mixed utilizing the fluidic mixer of the present invention.

BRIEF DESCRIPTION OF THE DRAWINGS

FIG. 5 is an enlarged perspective view of the first and second mechanisms of FIG. 3;

FIG. 6 is an exploded perspective view of the first and second mechanisms of FIG. 5;

FIG. 7 is an enlarged perspective view of the cam of FIG. 6;

DETAILED DESCRIPTION OF THE PREFERRED EMBODIMENT

Figure 1:
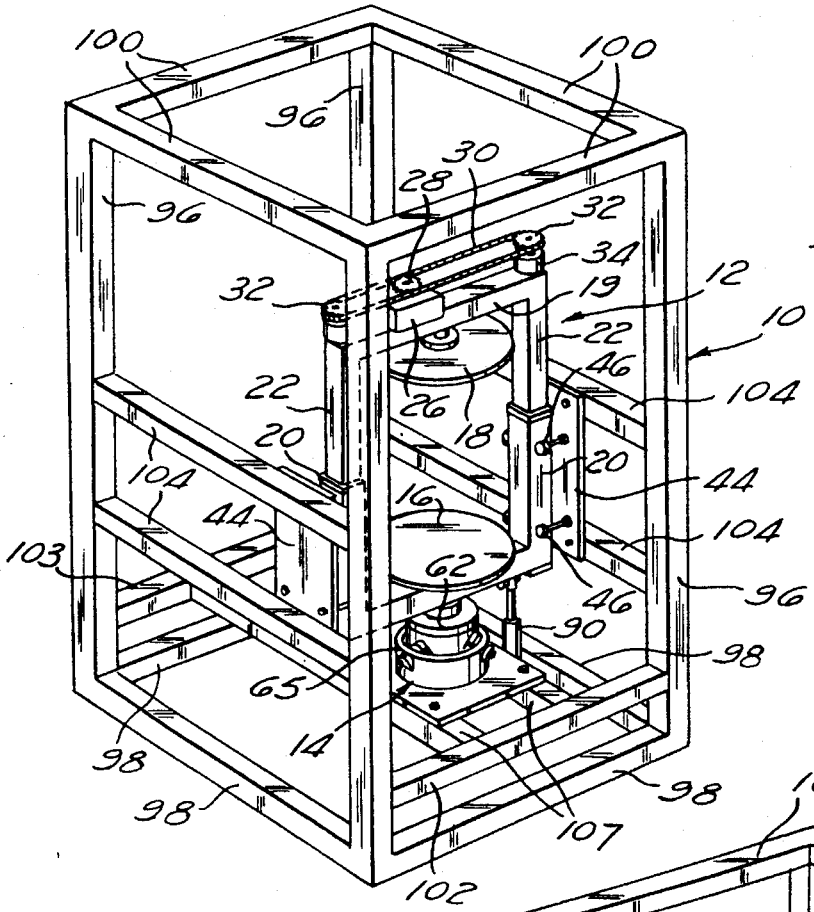
FIG. 1 is a perspective view of the fluidic mixer of the present invention having the housing removed therefrom.
Figure 2:
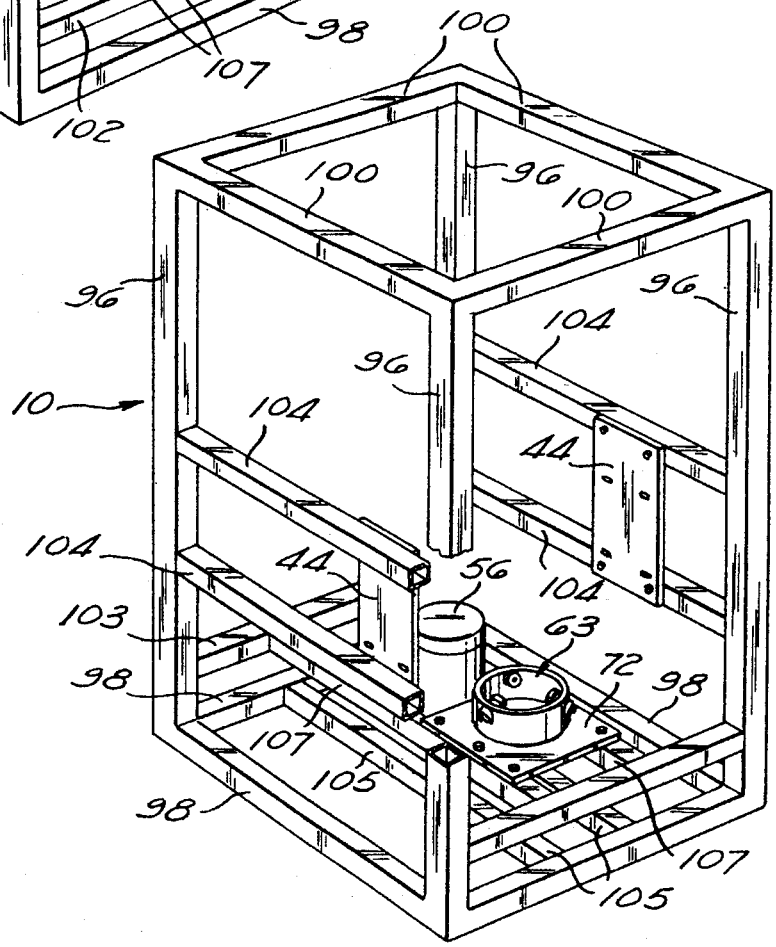
FIG. 2 is a perspective view of the fluidic mixer of FIG. 1 additionally having the clamps removed therefrom.

Although the fluidic mixer of the present invention is illustrated and described herein as a paint mixer, such illustration and description is by way of example only, and not by way of limitation. Thus, those skilled in the art will recognize that the present invention is suitable for mixing various different materials for use in various different applications.

As such, the detailed description set forth below in connection with the appended drawings is intended as a description of the presently preferred embodiment of the invention, and is not intended to represent the only form in which the present invention may be constructed or utilized. The description sets forth the functions and sequence of steps for constructing and operating the invention in connection with the illustrated embodiment. It is to be understood, however, that the same or equivalent functions and sequences may be accomplished by different embodiments that are also intended to be encompassed within the spirit and scope of the invention.

The fluidic mixer of the present invention is illustrated in FIGS. 1 through 15 of the drawings which depict a presently preferred embodiment of the invention. Referring now to FIGS. 1–13, the fluidic mixer is comprised of a generally rectangular framework 10 having a holder or clamp assembly 12 and an actuating assembly 14 disposed therein. Those skilled in the art will recognize that a housing, which has been removed for clarity in FIGS. 1–13, may optionally surround the generally rectangular framework 10 so as to prevent damage to nearby equipment and prevent injury to nearby personnel in the event that paint, a paint can, mixer parts, etc. should be hurled from the fluidic mixer of the present invention. The clamp assembly is configured to clampably capture and hold one or more paint cans. The actuator assembly 14 effects rotation and reciprocation of the paint can(s) so held in order to effect thorough mixing of the contents thereof.

The framework 10 preferably comprises four vertical members 96, four bottom cross members 98, four top cross members 100, front 102 and rear 103 lower cross members, and four intermediate side cross members 104. Additionally, bottom intermediate cross members 105 extend between two of the bottom cross members 98. Similarly, intermediate cross members 107 extend between front 102 and rear 103 intermediate cross members. Mount plate 72 is attached to the intermediate cross members 107.

Figure 3:
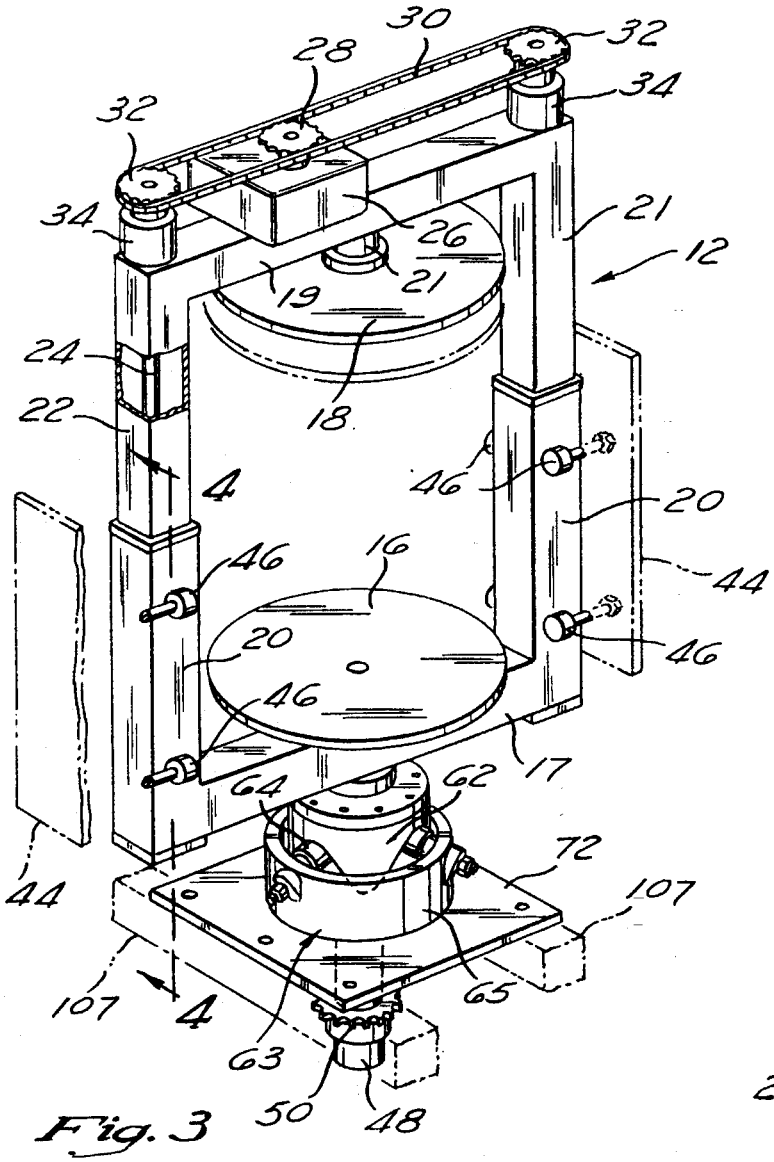
FIG. 3 is a perspective view of the clamp and the first and second mechanisms for rotating and reciprocating the clamp, respectively, removed from the mixer of FIG. 1.
Figure 4:
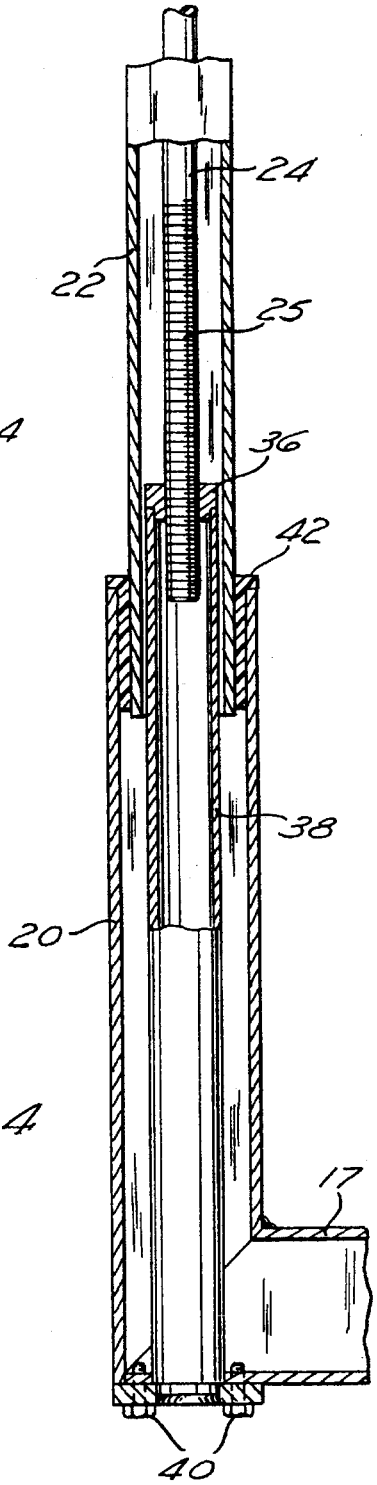
FIG. 4 is an enlarged cross-sectional side view of the first and second side members of the clamp of FIG. 3 showing the worm gear for effecting relative movement thereof so as to effect clamping and also showing the seal disposed intermediate the first and second side members.

With particular reference to FIGS. 3 and 4, the clamp assembly 12 comprises a first plate 16 and a second plate 18. The first 16 and second 18 plates are movable toward and away from one another so as to clampably capture one or more paint containers therebetween. More particularly, the second plate 18 is slidably disposed parallel to and spaced apart from the first plate 16 such that the second plate 18 may be moved toward and away from the first plate 16, i.e., downward and upward, respectively.

The first plate 16 is rotatably disposed upon a first end member and the second plate 18 is rotatably disposed upon a second end member 19. The first and second end members are interconnected via two first side members 20 and two telescoping second side members 22 extending therefrom so as to define a generally rectangular frame. Thus, the distance between the first 16 and second 18 plates is varied by sliding or telescoping the second side members 22 from within the first side members 20.

Lead screws 24 (best shown in FIG. 4) effect such sliding or telescoping of the second side members 22 into and out of the first side members 20 so as to move the second plate 18 toward and away from the first plate 16. Threaded portions 25 of the lead screws 24 engage nut 36 associated with the first side members 20 to effect such telescoping.

A clamp motor 26 drives a drive sprocket 28 which in turn drives a chain 30 to effect rotation of driven sprocket 32 attached to the upper-most ends of the lead screws 24. Thrust bearings 34 attach the lead screws 24 to the second side members 22. The nuts 36 are formed upon the upper-most ends of pedestals 38 so as to threadably engage the lower-most ends or threaded portions 25 of the lead screws 24 (as shown in FIG. 4). Pedestals 38 attach to the first side members 20 via fasteners 40.

Clamp motor 26 preferably comprises a DC motor. Sensing circuitry (not shown) monitors the current drawn by the DC clamp motor 26. An increase in the motor-drive current indicates that the container(s) are suitably clamped intermediate the lower 16 and upper 18 plates as the clamp motor 26 attempts to move the lower 16 and upper 18 plates further toward one another but is prevented from doing so by the container(s) captured therebetween. The use of a DC clamp motor 26 mitigates problems associated with current monitoring and prior art AC motors, thereby providing a more reliable and positive indication of proper clamping.

Thus, rotation of the clamp motor 26 in a first direction causes the lead screws 24 to likewise rotate in a first direction and thereby effect extension of the second side members 22 from the first side members 20, thus causing the second plate 18 to move away from the first plate 16 such that at least one paint container may be placed upon the first plate 16. Similarly, rotation of the clamp motor 26 in a second direction results in rotation of the lead screws 24 in a second direction such that the second side members 22 retract into the first side members 20, thereby moving the second plate 18 toward the first plate 16 so as to clampably capture the paint container(s) between the first plate 16 and the second plate 18.

A seal 42, preferably formed of DELRON or a similar polymer material, is disposed intermediate the first 20 and second 22 side members so as to seal the lead screw 24 therein from contamination as would occur during spillage or splashing of the contents of a paint container. Those skilled in the art will recognize that various different configurations of the seal 42 are likewise suitable for preventing the introduction of a contaminants into the interior of the first 20 and second 22 side members.

Figure 12:
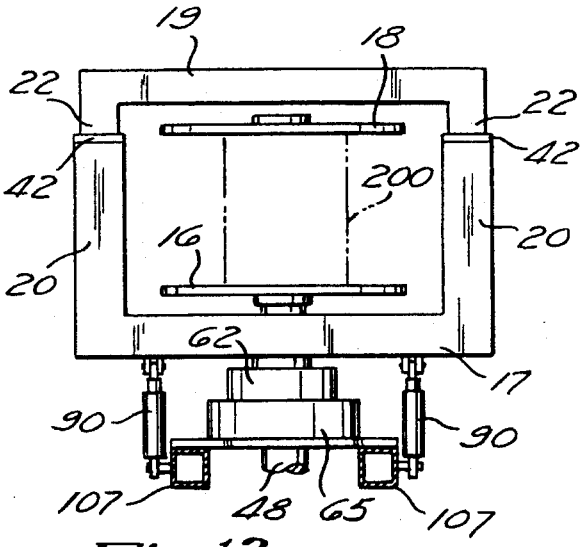
FIG. 12 is a front elevation of the clamp assembly of FIG. 1 showing the first and second plates of the clamp in the clamping position thereof.
Figure 13:
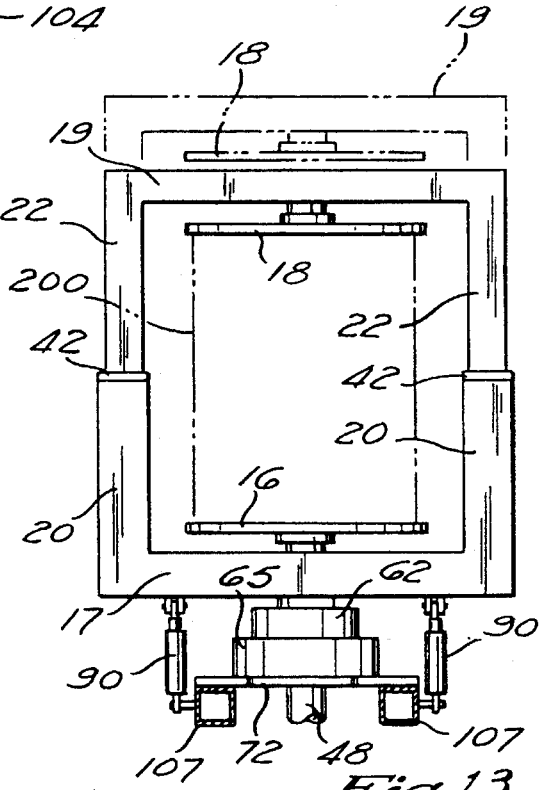
FIG. 13 is a front elevation of the clamp assembly of FIG. 1 showing the first and second plates of the clamp in the non-clamping position thereof.

Flanges 44 formed upon the framework 10 have rollers 46 extending therefrom so as to limit movement of the first side members 22 to up and down reciprocating linear motion as illustrated in FIGS. 12 and 13. FIG. 12 shows the second side members 22 retracted into the first side members 20 so as to effect clamping of the paint can(s) disposed between the first 16 and second 18 plates. FIG. 13 shows the second side members 22 telescoped or extended from the first side members 20 so as to facilitate removal and insertion and removal of paint cans intermediate the first 16 and second 18 plates.

With particular reference to FIGS. 5–7, the actuation assembly 14 comprises a first mechanism for effecting rotation of the container and a second mechanism for effecting reciprocating linear motion of the container. The first mechanism effects rotation of the container and the second mechanism effects reciprocation of the container simultaneously so as to effect thorough mixing of the contents of the container as described in detail below.

The first mechanism comprises a lower or first shaft 48 having a sprocket 50 attached thereto via a set screw 52 and an optional key and keyway (not shown) and is driven by chain 54 (FIG. 11) which is driven by sprocket 55 formed upon the output shaft 57 of mix motor 56. An upper or second shaft 56 is slidably attached in a co-axial fashion to said first shaft 48 via cam 62 such that the first shaft 48 drives, i.e., effects rotation of, the second shaft 56. The first plate 16 is formed upon the second shaft 56, preferably via flange 58 using fasteners, i.e., bolts, passing through apertures 60 formed in the flange 58.

The cam 62 rides upon a roller assembly 63 comprised of at least one, preferably three, rollers 64 disposed upon collar 65. As the cam 62 rotates about the rollers 64 of the roller assembly 63, it urges the second shaft 56 up and down in a linear reciprocating motion. Thus, rotation of the first shaft 48 results in both rotation and linear reciprocation of the second shaft 56.

With particular reference to FIG. 6, the first shaft 48 is slidably attached to the cam 62 such that as the first shaft 48 rotates, the cam 62 moves up and down in linear reciprocating motion with respect thereto. The first shaft 48 preferably has keys or splines 66 formed thereon which are received into corresponding keyways or splines 68 so as to effect transmission of rotation from the first shaft 48 to the cam 62, while also allowing reciprocating linear motion of the cam 62 relative to the first shaft 48. Thus, rotation of the first shaft 48 results in like rotation of the cam 62, as well as linear reciprocating motion of the cam 62 as the cam 62 rides up and down over the rollers 64 of the roller assembly 63.

The rollers 64 are preferably attached to the roller assembly 63 via fasteners, i.e., nuts 70 and bolts 71. Those skilled in the art will recognize that various other means for attaching the rollers 64 to the roller assembly 63 are likewise suitable.

The roller assembly 63 is disposed upon and rigidly attached to mounting plate 72 which is similarly rigidly attached to the framework 10, preferably via fasteners to facilitate easy removal and replacement thereof.

The second shaft 56 is rigidly attached to the cam 62 via key 76 formed thereon which is received into keyway 78 of the cam 62 so as to transfer rotation of the cam 62 to the second shaft 56. The cam 62 is secured upon the second shaft 56 via set screw 79.

Figure 8:
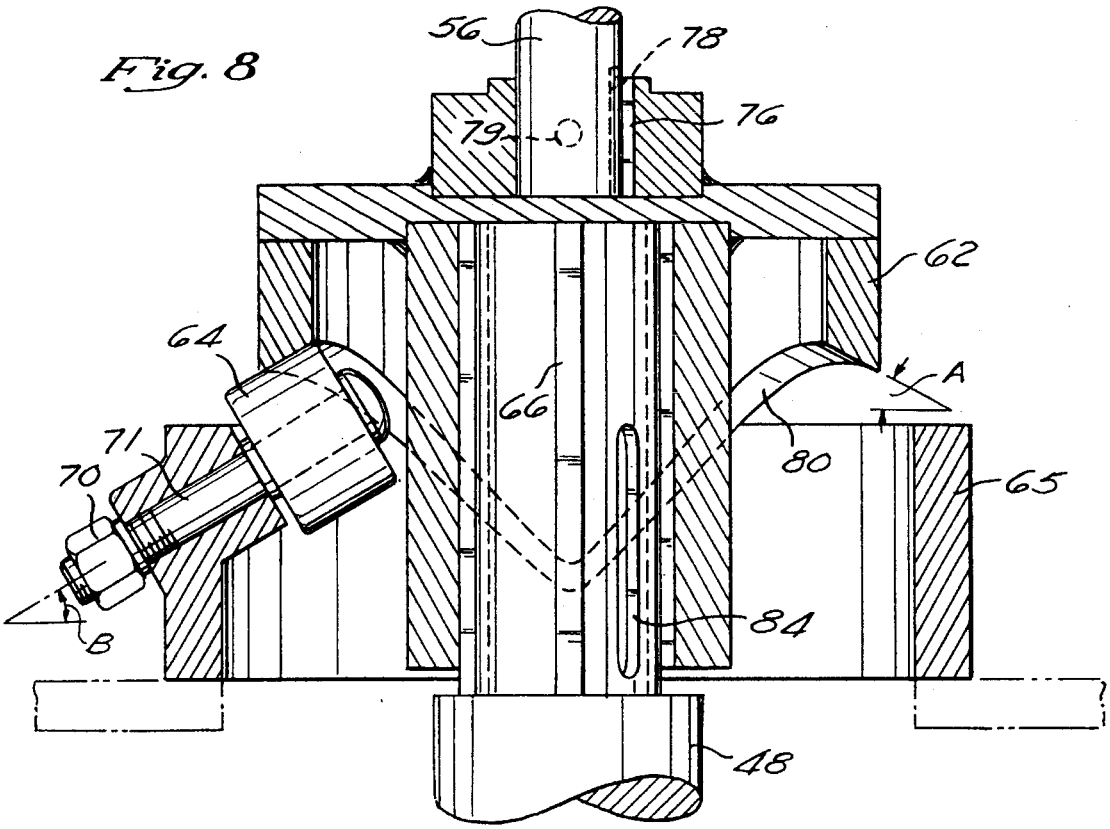
FIG. 8 is an enlarged cross-sectional view of the cam and rollers of FIG. 6.
Figure 9:
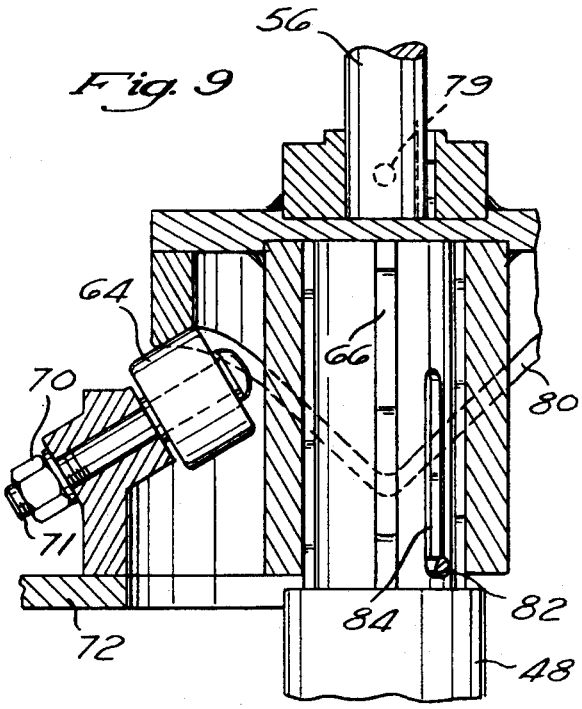
FIG. 9 is a cross-sectional side view of the cam and rollers of FIG. 8 showing the cam in its lower-most position.
Figure 10:
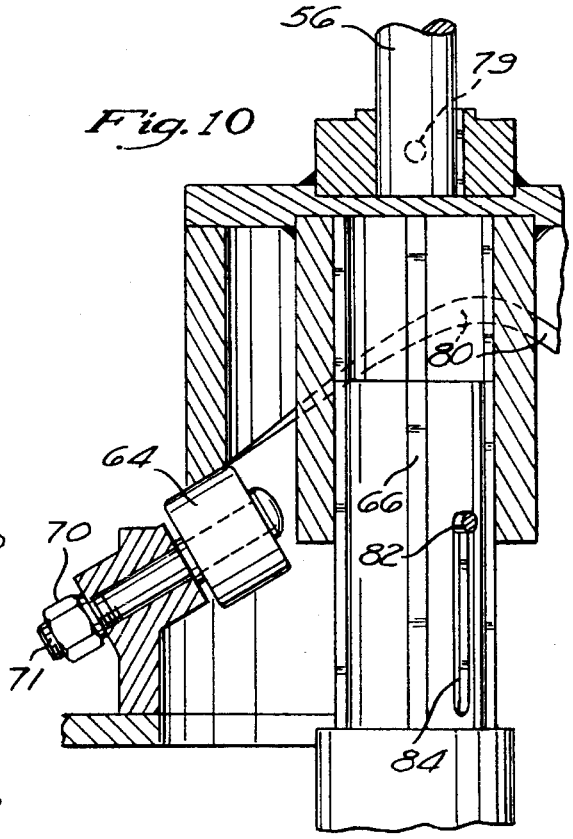
FIG. 10 is a cross-sectional side view of the cam and rollers of FIG. 8 showing the cam in its upper-most position.
Figure 11:
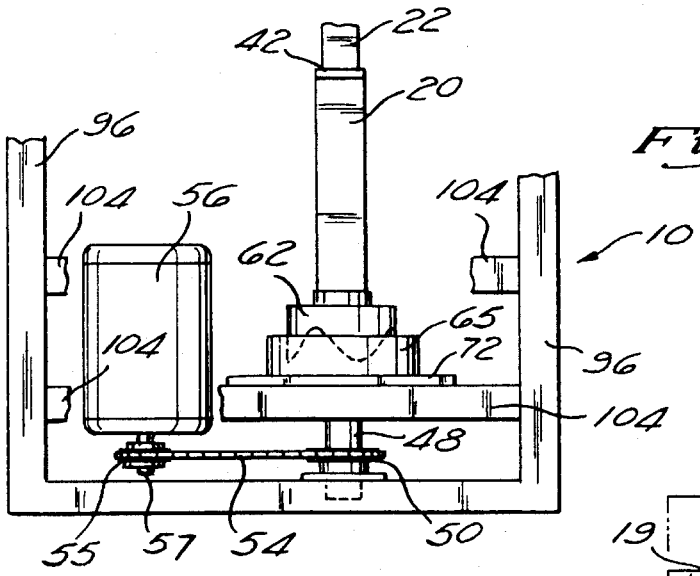
FIG. 11 is a side elevation of the fluidic mixer of FIG. 1 showing the motor for driving the first and second mechanisms thereof.

With particular reference to FIG. 8, the contact surface of the cam 62 preferably comprises a beveled surface 80. The rollers 64 of the roller assembly 63 are preferably inclined upwardly at an angle corresponding to the angle of the beveled surface 80 so as to effect self-centering of the cam 62 upon the roller assembly 63. The beveled surface 80 of the cam 62 is preferably formed at an angle A of 32 degrees to the horizontal and the rollers 64 are similarly mounted at an angle B of 32 degrees to the horizontal so as to effect such self-centering. Those skilled in the art will recognize that various other angles and/or configurations of the cam 62 and the rollers 64 are likewise suitable. For example, the rollers 64 could be angled downwardly in a similar fashion to likewise achieve self-centering.

A set screw 82 (FIG. 7) formed in the cam 62 is received within a longitudinal slot 84 formed within the first shaft 48 so as to limit linear reciprocal motion of the cam 62 relative to the first shaft 48, thereby slidably attaching the cam 62 to the first shaft 48.

Springs 90 (best shown in FIGS. 12 and 13) bias the clamp assembly 12 in its lower-most position and assure continuous positive contact of the cam 62 with the rollers 64 of the roller assembly 63 during rotation of the cam 62 relative to the roller assembly 63.

Figure 14:
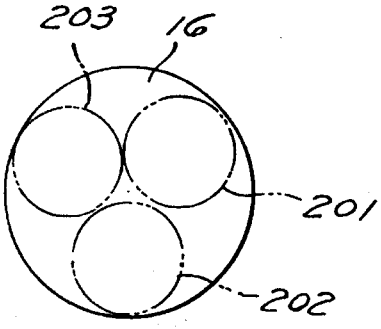
FIG. 14 illustrates the placement of three paint containers upon the first plate of the clamping mechanism.

Having thus described the structure of the fluidic mixer of the present invention, it may be beneficial to describe the use and operation thereof. Clamp motor 26 is actuated so as to rotate lead screws 24 in a direction which causes second side members 22 to extend from first side members 20, thereby moving plate 18 away from plate 16 to increase the distance therebetween. One or more containers of paint having pigment and/or other additives to be mixed with paint base contained therein are placed upon the lower plate 16. As shown in FIG. 14, a plurality, e.g., three, paint containers 201, 202, and 203 can be positioned side-by-side upon the lower plate 16 and the clamped between the lower plate 16 and the upper plate 18. Those skilled in the art will recognize that various numbers of various different sizes of paint containers may similarly be positioned intermediate the lower 16 and upper 18 plates of the clamp assembly 12.

With the paint container(s) disposed upon the lower plate 16, the clamp motor 26 is actuated so as to cause the lead screws 24 to rotate in a direction which causes the second side members 22 to retract into the first side members 20, thereby moving the top plate 18 toward the bottom plate 16 so as to clampably capture the paint container(s) therebetween.

The DC current drawn by clamp motor 26 is monitored so as to provide an accurate and reliable indication that proper clamping has been achieved. Proper clamping is indicated by a rise in clamp motor current as the paint container(s) limit further movement of the first 16 and second 18 plates toward one another, thus increasing the load upon the clamp motor 26. The use of such a DC clamp motor 26 thus mitigates the problem of inaccurate clamping indication and consequent loosening of the paint container(s) clamped intermediate the first 16 and second 18 plates, frequently resulting in splashed and/or spilled paint.

As the second side member 22 extends from and retracts into the first side member 20, DELRON seals 42 prevent the introduction of contaminants such as paint, dirt, etc., thereinto, thus preventing contamination of the lead screws 24 and/or nuts 36. As discussed above, such contamination frequently provides a false fully clamped indication to current-sensing circuitry in prior art devices, thus resulting in inadequate clamping pressure and potentially resulting in the paint container breaking free of the clamping mechanism of such prior art devices. Thus, in the fluidic mixer of the present invention, the threads of the lead screws 24 and the nuts 36 are maintained in an uncontaminated and clean condition such that they work in a smooth and uniform manner throughout the length of the threaded portion 25 of the lead screw 24 thus not binding or providing any false indication of proper clamping.

Once properly clamped between the lower 16 and upper 18 plates of the clamping apparatus 12, motor 18 is activated so as to effect rotation of lower shaft 48, thus similarly resulting in rotation of upper shaft 56 and consequently of rotation of lower plate 16 and the paint container(s). Rotation of the lower shaft 48 is transmitted through the cam 62 via spline 66 formed upon the lower shaft 48 and corresponding splines or keyways 68 formed within the cam 62 and then to upper shaft 56 via key 76 formed thereon and received into keyway 78 formed within the cam 62. Rotation of the cam 62 results in up and down or linear reciprocating motion thereof as the beveled surface 80 rides upon the roller 64 of the roller assembly 63.

Such linear reciprocating motion of the cam 62 is not transmitted to the first shaft 48 since the cam 62 is slidably disposed thereon. Such linear reciprocating motion of the cam 62 is transferred to the upper shaft 56 since the upper shaft 56 is rigidly connected to the cam 62 via set screw 79. The linear reciprocating motion is transmitted to the entire clamp assembly 12 such that the lower member 17, upper member 19, two first side members 20, two second side members 22, roller plate 16, and upper plate 18, as well as the paint container(s) all move up and down with linear reciprocating motion. Rollers 46 prevent rotation of the lower member 17, upper member 19, first side members 20, and second side members 22.

Bearing 21 facilitates rotation of the upper plate 18 within the clamp assembly 12. A similar bearing, preferably a thrust bearing, disposed within roller member 17 similarly facilitates rotation of roller plate 16 within the clamp assembly 12 while accommodating forces applied thereto due to linear reciprocating movement of the clamp assembly 12.

After mixing the contents of the paint container(s) for a desired length of time, the mix motor 56 is deactivated. The clamp motor 26 is then activated so as to cause lead screws 24 to rotate in a direction effecting extension of the second side members 22 from the first side members 20, thus moving the upper plate 18 away from the lower plate 16 such that the paint container(s) may be removed from the lower plate 16.

Referring now to FIG. 14, three individual paint containers 201, 202, and 203 are positioned upon the lower plate 16 such that the contents thereof may be mixed simultaneously with one another, thereby increasing the utility of the fluidic mixer of the present invention.

Figure 15:
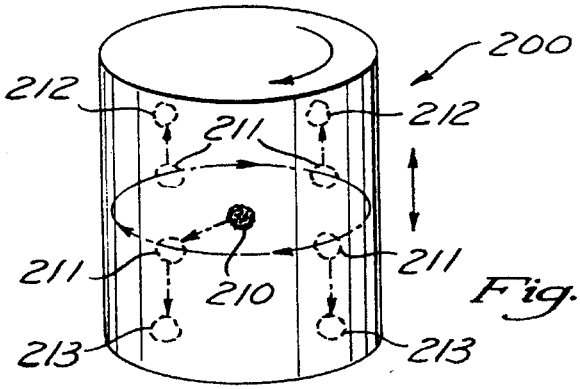
FIG. 15 schematically illustrates distribution of pigment throughout the paint base as occurs during mixing thereof according to the present invention.

Referring now to FIG. 15, increased mixing efficiency is achieved through the simultaneous application of rotation and linear reciprocating motion to the contents of the paint container. For example, a quantity of pigment 210, typically denser than paint base, disposed centrally within the paint container 200, is caused to move outwardly toward the periphery of the paint container 200. As the pigment 210 moves toward a position 211 at the periphery of the paint container 200, linear reciprocating motion causes the pigment to be distributed to upper positions 212 and lower positions 213 throughout the height of the container. Thus, the pigment 210 is distributed uniformly throughout the entire volume of the container in a manner which is more efficient and quicker than occurs in contemporary paint mixers.

It is understood that the exemplary fluidic mixer described herein and shown in the drawings represents only a presently preferred embodiment of the invention. Indeed, various modifications and additions may be made to such embodiment without departing from the spirit and scope of the invention. For example, various configurations of the clamp assembly are contemplated. Additional first 20 and second 22 side members may be added, as required. The configuration of the lower 16 and upper 18 plates may be varied so as to specifically accommodate various sizes, configurations, and numbers of containers. Also, the configuration of the framework and housing may be varied, as desired. Thus, these and other modifications and additions may be obvious to those skilled in the art and may be implemented to adapt the present invention in a variety of different applications.

What is claimed is:

1. A mixer for mixing a container's contents, the mixer comprising:

a) a holder for holding the container;

b) a first mechanism for effecting rotation of the container;

c) a second mechanism for effecting reciprocating linear motion of the container; and d) wherein said first mechanism effects rotation of the container and said second mechanism effects reciprocation of the container simultaneously so as to effect thorough mixing of the contents of the container.

2. The mixer as recited in claim 1 wherein said holder comprises a clamp.

3. The mixer as recited in claim 2 wherein said clamp comprises:

a) a first plate upon which the container is supported; and b) a second plate disposed generally parallel to said first plate and movable toward and away from said first plate.

4. The mixer as recited in claim 3 further comprising a DC motor for moving said second plate toward and away from said first plate.

5. The mixer as recited in claim 4 further comprising at least one lead screw driven by said motor for moving said second plate toward and away from said first plate.

6. The mixer as recited in claim 5 further comprising:

a) a generally rectangular frame, said frame comprising:

i) a first end member upon which said first plate is rotatably disposed;

ii) a second end member upon which said second plate is rotatably disposed;

iii) two first side members extending from said first end member;

iv) two second side members extending from said second end member, each of said second side members slidably engaging one of said first side members; and v) wherein said lead screw(s) comprise two lead screws, one lead screw extending along each engaged first and second side members so as to effect sliding of said second side members relative to said first side member.

7. The mixer as recited in claim 6 wherein:

a) one of said first and second side members telescopes into the other of said first and second side members; and b) said lead screws are enclosed within said first and second side members; and c) further comprising seals sealing said first and second side members so as to mitigate contamination of said lead screws.

8. The mixer as recited in claim 3 wherein:

a) said first mechanism comprises:

i) a first shaft rotatably driven by a motor;

ii) a second shaft co-linear to and slidably engaging said first shaft such that said first shaft rotatably drives said second shaft, said first plate being formed upon said second shaft; and b) said second mechanism comprises:

i) a cam formed upon said second shaft; and ii) at least one roller upon which said cam rides upon so as to effect reciprocating linear motion of said second shaft.

9. The mixer as recited in claim 8 wherein said cam is generally annular in configuration, is co-axially aligned with said second shaft, and comprises a beveled surface contacting a complimentary beveled surface formed upon said roller(s) so as to effect centering of said second shaft

10. The mixer as recited in claim 9 wherein said cam beveled surface and said roller(s) beveled surface both comprise 32-degree bevels.

11. The mixer as recited in claim 8 further comprising a spring for urging said cam and said roller(s) into contact with one another.

12. The mixer as recited in claim 1 further comprising at least one motor for driving said first and second mechanisms.

13. The mixer as recited in claim 1 further comprising a single motor for driving both said first and second mechanisms.

14. The mixer as recited in claim 1 wherein said holder is configured to accommodate a plurality of containers.

15. The mixer as recited in claim 1 further comprising a housing substantially enclosing said holder to mitigate problems associated with spillage of the contents of the container.

16. A mixer for mixing a container's contents, the mixer comprising:

a) a frame;

b) a housing disposed about said frame;

c) a clamp configured to hold at least one container disposed within said frame, said clamp comprising:

i) a first plate upon which the container is supported; and ii) a second plate disposed generally parallel to said first plate and movable toward and away from said first plate;

d) a motor driving at least one lead screw for moving said second plate toward and away from said first plate;

e) a generally rectangular frame, said frame comprising:

i) a first end member upon which said first plate is rotatably disposed;

ii) a second end member upon which said second plate is rotatably disposed;

iii) two first side members extending from said first end member;

iv) two second side members extending from said second end member, each of said second side members slidably engaging one of said first side members; and v) wherein said lead screw(s) comprise two lead screws, one lead screw extending along each engaged first and second side members so as to effect sliding of said second side members relative to said first side member;

f) a first mechanism for effecting rotation of said clamp, said first mechanism comprising:

i) a first shaft rotatably driven by a motor; and ii) a second shaft co-linear to and slidably engaging said first shaft such that said first shaft rotatably drives said second shaft, said first plate being formed upon said second shaft;

g) a second mechanism for effecting reciprocating linear motion of said clamp, said second mechanism comprising:

i) a cam formed upon said second shaft; and ii) at least one roller upon which said cam rides so as to effect reciprocating linear motion of said second shaft; and h) a motor for driving said first and second mechanisms.

17. A method for mixing a container's contents, the method comprising the steps of:

a) holding the container in a holder;

b) rotating said holder;

c) simultaneously linearly reciprocating said holder; and d) wherein the simultaneous rotation and reciprocation of said holder effects mixing of the contents of the container.

18. The method as recited in claim 17 wherein the step of holding the container comprises holding the container in a clamp.

19. The method as recited in claim 18 wherein the step of holding the container in a clamp comprises:

a) moving first and second plates away from one another;

b) disposing the container upon the first plate; and c) moving the second plate toward the first plate so as to clamp the container between the first and second plates.

20. The method as recited in claim 19 wherein:

a) the step of rotating the container comprises rotating, via a motor, a shaft upon which the first plate is formed; and b) moving a cam upon at least one roller, the cam effecting reciprocating linear motion of the shaft.

21. The method as recited in claim 20 further comprising the step of maintaining centering of the shaft by moving a beveled cam upon complimentary beveled roller(s).

22. The method as recited in claim 20 further comprising the step of urging the cam and cam roller(s) into contact with one another.

23. The method as recited in claim 19 wherein the step of holding the container comprises telescoping at least one of first and second side members into the other of first and second side members via a lead screw disposed therein.

24. The method as recited in claim 23, further comprising the step of sealing the first and second side members so as to prevent contamination of the lead screw contained therein.

25. The method as recited in claim 17 wherein the step of holding the container comprises clamping the container intermediate first and second plates by driving a lead screw with a motor so as to effect movement of the first and second plates toward one another.

* * * * *